US009227124B1

(12) United States Patent
Sparks

(10) Patent No.: US 9,227,124 B1
(45) Date of Patent: Jan. 5, 2016

(54) APPARATUS AND METHOD FOR TRAINING A BASEBALL PITCHER

(71) Applicant: Eric Sparks, Cohoes, NY (US)

(72) Inventor: Eric Sparks, Cohoes, NY (US)

( * ) Notice: Subject to any disclaimer, the term of this patent is extended or adjusted under 35 U.S.C. 154(b) by 0 days.

(21) Appl. No.: 14/542,556

(22) Filed: Nov. 15, 2014

(51) Int. Cl.
*A63B 69/00* (2006.01)
*A63B 71/00* (2006.01)

(52) U.S. Cl.
CPC ..... *A63B 69/0002* (2013.01); *A63B 2069/0006* (2013.01)

(58) Field of Classification Search
CPC ..... A63B 2/02; A63B 69/002; A63B 67/002; A63B 71/022; A63B 2069/0006; A63B 2243/00041
USPC ..... 473/422, 451, 452, 206, 207, 215, 212, 473/218, 415, 468; 482/123–124, 129; 434/252, 257
See application file for complete search history.

(56) References Cited

U.S. PATENT DOCUMENTS

| | | | | |
|---|---|---|---|---|
| 4,846,471 | A | 7/1989 | Haysom | |
| 6,500,078 | B1 | 12/2002 | Williams et al. | |
| 6,945,883 | B1 | 9/2005 | Williams et al. | |
| 7,338,395 | B1 | 3/2008 | Hurley | |
| 8,672,781 | B2 * | 3/2014 | Sparks | A63B 21/02 473/422 |
| 2012/0270686 | A1 * | 10/2012 | Sparks | A63B 21/02 473/451 |

* cited by examiner

*Primary Examiner* — Mitra Aryanpour
(74) *Attorney, Agent, or Firm* — Falati Law Firm

(57) ABSTRACT

The disclosure relates to a baseball pitcher training apparatus for training a pitcher in controlling his lower and upper body portions in the movement sequence of the human body associated with throwing a baseball during the pitch preparation phase as well as the delivery and follow-through phase to conserve stress or strain in the arm and leg muscles. The apparatus has a pitching mound and a frame structure comprising two vertical post assemblies connected at the top by a horizontal cross beam assembly. Light bag weights are suspended from the cross beam assembly. The pitcher learns his body mechanics from following a pitching line indicated by the light bag weights and gauging his position by calibration marks on the pitching mound.

8 Claims, 4 Drawing Sheets

APPARATUS AND METHOD FOR TRAINING A BASEBALL PITCHER

CROSS-REFERENCE TO RELATED APPLICATIONS

This application is linked to prior U.S. Pat. No. 8,672,781 B2.

STATEMENT REGARDING FEDERALLY SPONSORED RESEARCH OR DEVELOPMENT

NOT APPLICABLE

BACKGROUND

All too often promising baseball and other sports careers can be cut short due to injury sustained from improper training methods. There is no good reason why this cannot be prevented from happening.

There are several prior art references related to baseball and in particular teaching a pitcher how to improve his pitching abilities. Representative examples of them can be found in the following patents: Williams, U.S. Pat. No. 6,945,883, Williams, U.S. Pat. No. 6,500,078, Hayson, U.S. Pat. No. 4,846,471 and Hurley U.S. Pat. No. 7,338,395. The Williams patents teach a device that will help a pitcher achieve proper foot alignment as the pitcher delivers the pitch. These patents do not attempt to teach the pitcher how to achieve an efficient, effective and non-stress producing pitching throw. Hayson teaches a method for training and warming up baseball pitchers using a baseball attached to a cord and the pitcher simulating a pitching movement. It does not teach the pitcher how to gauge his body movement within the delivery motion of throwing a baseball. Hurley teaches a device that trains the pitcher in the appropriate alignment of the legs to give them their direct line during the pitching motion to home plate. It does not teach baseball pitchers how to conserve stress or strain to those muscles used in pitching.

For the foregoing reasons, there is a need for an apparatus that can train a pitcher not only in how to pitch a baseball but also in how to do so without incurring injuries as a result of lax and improper training methods.

SUMMARY

This present apparatus is a training device to teach a baseball pitcher in the proper body mechanics of how to use muscles associated with throwing a baseball so as to conserve stress or strain to those muscles. In addition, it allows measurement and recording of feet positions by the baseball pitcher and reinforces the bio-dynamics of the pitcher throwing motion. This apparatus aims to eliminate recurrent stress and strain to athletes' muscles and body mechanics during training and to reinforce a positive and forceful throwing motion. By using this apparatus the baseball pitcher or other athlete can learn how to recognize his body motion and obtain feedback on the forces and mechanics used in pitching a baseball. The present invention is directed to an apparatus to instruct or train a pitcher in the proper body mechanics of throwing a baseball and has been developed to assist students to maximize their throwing potential that satisfies the need to eliminate the repetitive stress syndrome problem of more conventional throwing methodologies. Proper body mechanics are essential to correct repeated delivery of a pitch, control, velocity, and to prevent injury. The apparatus comprises a collapsible frame structure having two vertical and height adjustable post assemblies connected at the top end of each vertical post assembly by a horizontal cross beam. Two light bag weights are suspended from the crossbeam at defined intervals and can be adjusted for height. The apparatus also comprises a raised pitching mound which can be secured to the ground. The pitching mound comprises a flat pitching plate which is parallel to whatever surface the pitching mound is placed on and a sloping landing platform or inclined plane which slopes to ground level and is contiguous with the raised pitching plate. There are two adjustable position markers which slide along the length of the pitching plate and the landing slope or in another embodiment just one adjustable position marker which can slide unimpeded along the entire length of the pitching mound which includes the pitching plate and the sloping landing platform. The position marker slides by means of a recessed track or rail that runs along the length of the pitching mound and which enables calibration of distance by sliding across notches or markings that are equally spaced and are used for calculating distance travelled and recording the follow-through feet positioning of the baseball pitcher. The apparatus is designed to be manufactured with different materials. In addition, the apparatus provides a method for a baseball pitcher to learn how to pitch a baseball without incurring injury.

DRAWINGS

These and other features, aspects, and advantages of the present invention will become better understood with regard to the following description, appended claims, and accompanying drawings where:

Drawings - Reference Numerals

Figure 1:
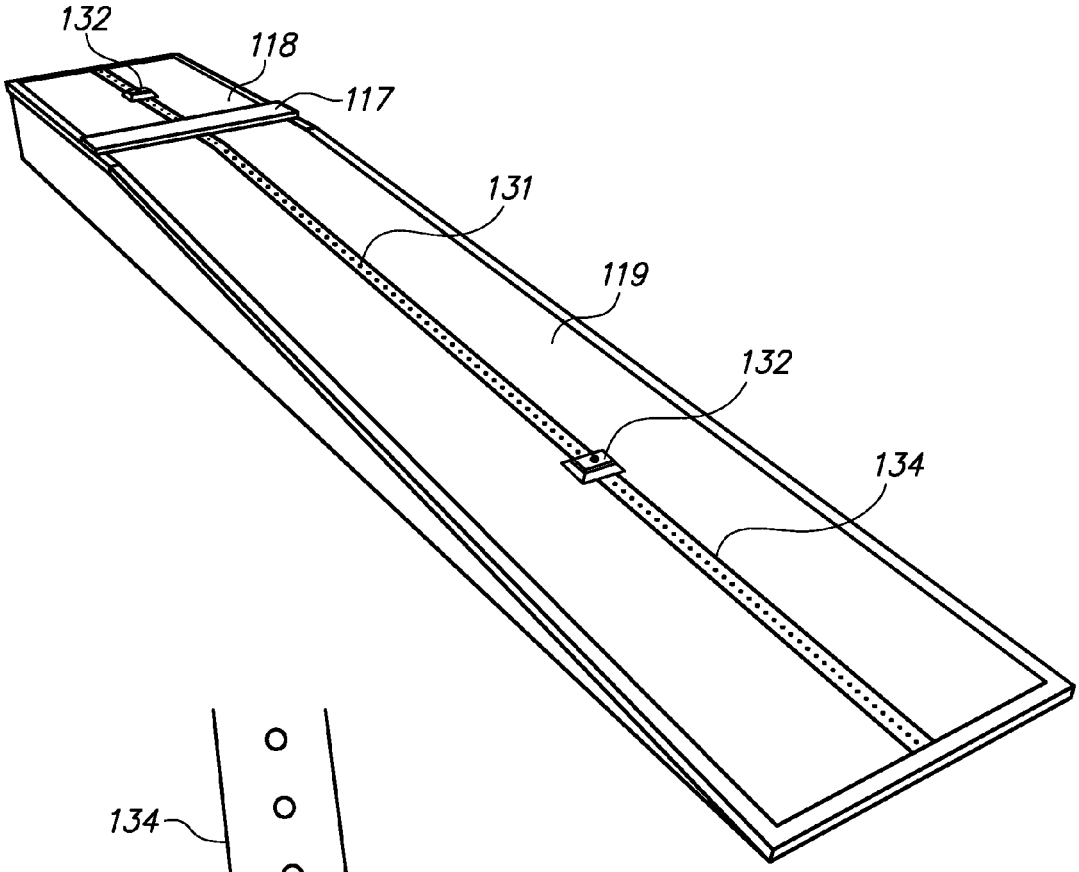
FIG. 1 shows an angled view of the pitching mound including pitching plate and landing slope along with adjustable position marker and track or rail for the adjustable position marker.

| | | | |
|---|---|---|---|
| 100 | Training apparatus | 101 | lower vertical post member |
| 102 | lower vertical post member | 103 | upper vertical post member |
| 104 | upper vertical post member | 113 | light bag weight |
| 114 | light bag weight | 116 | horizontal cross beam assembly |
| 117 | pitching mound | 118 | pitching plate |

-continued

| Drawings - Reference Numerals | | | |
|---|---|---|---|
| 119 | landing slope | 123 & 124 | base members for vertical post assemblies |
| 125 & 126 | receptacles at top ends of upper vertical post assemblies | | |
| 128 & 129 | vertical post assemblies | 130 | distance measurement marker |
| 131 | calibrations or calibrated notches | 132 | adjustable position marker |
| 133 | rods | 134 | recessed rail or track |

DESCRIPTION

This is an apparatus to teach a pitcher the proper body mechanics when throwing a baseball so as to conserve stress or strain to those muscles used in pitching/throwing the baseball. In addition, it allows measurement and recording of feet positions by the baseball pitcher and reinforces the bio-dynamics of the pitcher throwing motion. Specifically it will teach the pitcher the correct body movement to avoid incurring injuries that could jeopardize a baseball career. It will teach the pitcher to become spatially aware of the pitcher's position and movement of arms, legs, feet and torso throughout the delivery of the pitch in order to avoid injury to the pitcher that may result from improper body mechanics and to reinforce a positive and forceful throwing motion.

This training apparatus 100 has been designed so that it may be used to strengthen and conserve usage of all the muscles associated with throwing a baseball. This training apparatus 100 can be used by the little leaguer, up through the professional athlete. The subject apparatus provides a training device for a baseball pitcher, which is lightweight, portable, easily erected and can be used indoors in a gymnasium or outdoors on a practice field.

FIG. 1 shows the pitching mound alone. The pitching mound is comprised of a pitching plate 118 and a landing slope or inclined plane 119 and contains recessed rail or track 134 with calibrations or calibrated notches 131 and adjustable position marker 132.

Figure 2:
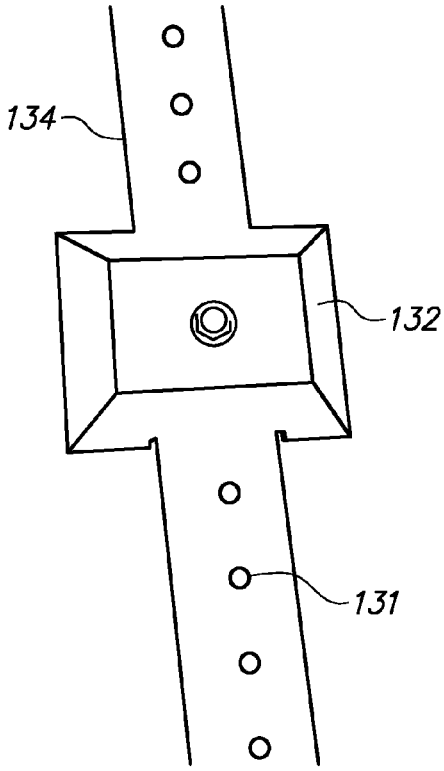
FIG. 2 shows a portion of the track or rail with the adjustable position marker positioned on it.

FIG. 2 shows a close up of the recessed rail or track 134 containing calibrations or calibrated notches 131 and adjustable position marker 132.

Figure 3:
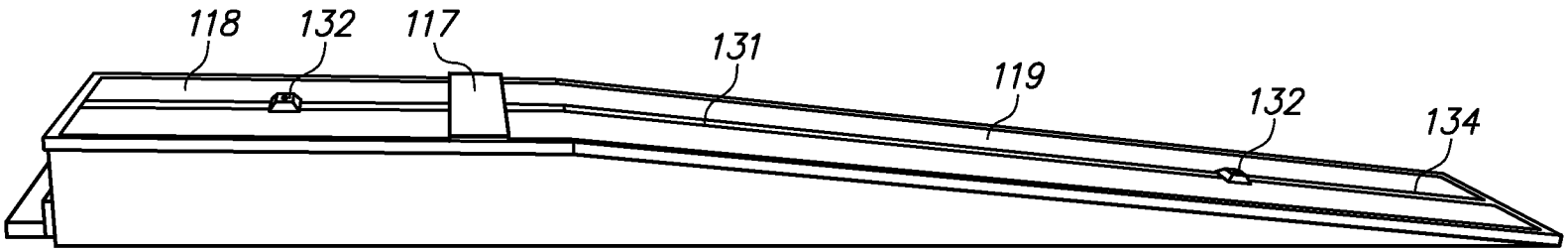
FIG. 3 shows a side view of the pitching mound.

FIG. 3 shows a side view of the pitching mound 117.

Figure 4:
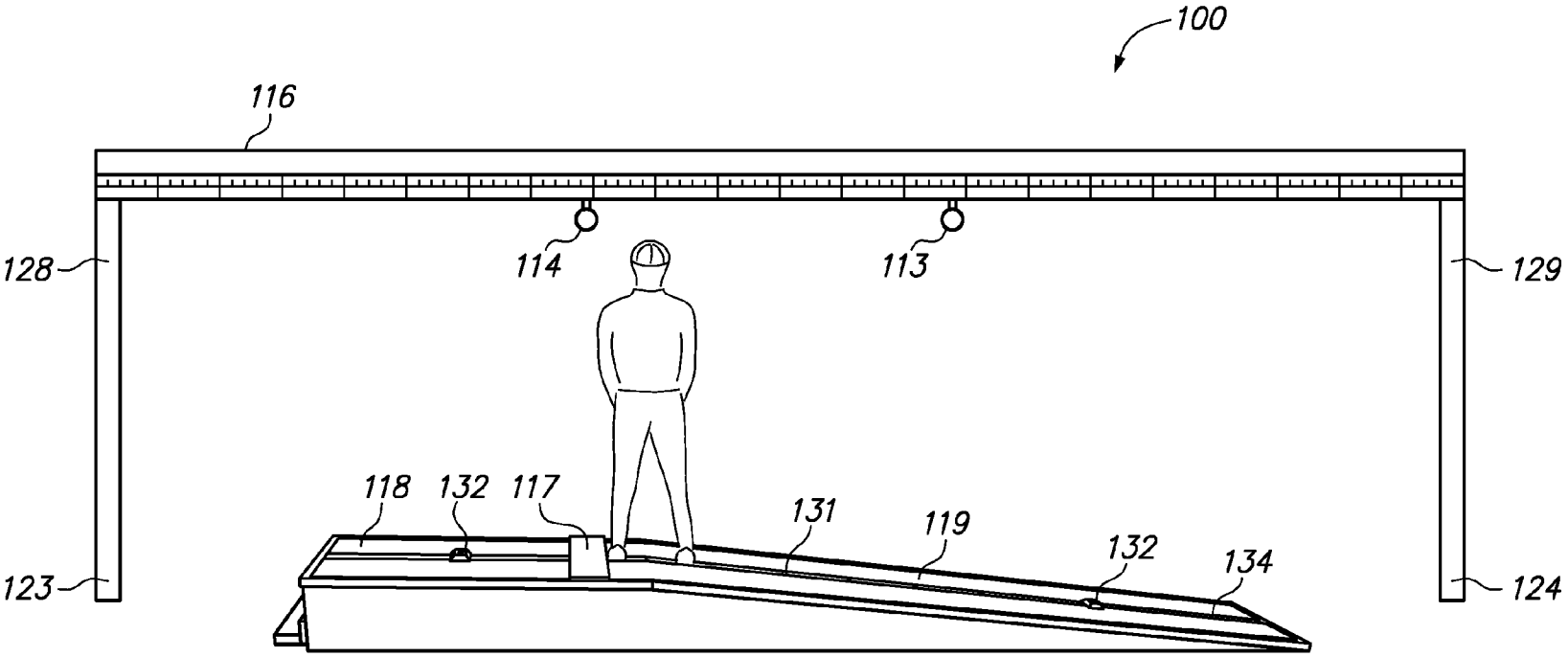
FIG. 4 shows a side view of the apparatus, showing the primary frame structure in an assembled condition, with the light bag weights attached thereto and the pitching mound placed directly underneath.

FIG. 4 generally shows a training apparatus to train a baseball pitcher which comprises a primary frame structure which includes two vertical post assemblies 128 and 129 and a horizontal cross beam assembly 116. Light bag weights 113 and 114 are suspended from the horizontal cross beam assembly 116. A pitching mound 117 as shown in FIGS. 1 and 3 is inserted on the ground at the base of the apparatus and between both the vertical post assemblies and underneath the cross beam member. There are two base members 123 and 124 placed on the ground and into which the vertical post assemblies are inserted which are shown more fully in FIG. 5.

When a pitcher practices a throw of a baseball, the pitcher stands on the pitching mound 117 that is secured to the ground by a securing means. The purpose of the securing means is to prevent the pitching mound from shifting during use.

There are two light bag weights 113 and 114 suspended from the cross beam assembly 116. One light bag weight 113 is suspended above the pitching plate 118. The other light bag weight 114 is suspended along the landing slope 119. The light bag weights drop down from above from the horizontal cross beam member 116 and can be adjusted for height as required.

There are calibration notches 131 longitudinally marked both on the pitching plate 118 and on the landing slope permitting the user to check his stride length and the position of his feet on the landing slope area or inclined plane 119. There is also an adjustable position marker 132 that slides along a recessed rail or track and which can be positioned to record the location of the various feet positions or landing positions of the feet of the pitcher.

The horizontal cross beam assembly 116 has a distance measurement marker 130 along the entire length of the horizontal cross beam assembly.

The pitcher starts his/her motion on the pitching plate 118. The pitcher will wind his/her body to throw the baseball and aim to make contact with the light bag weight 113 suspended directly above the pitching plate. In other words, the pitcher will hit the light bag weight 113 behind the pitcher with his throwing hand and then hit the light bag weight 114 suspended at the front of pitcher above the landing slope 119 with the same throwing hand to guide the pitcher as to the target area for releasing the ball.

Figure 5:
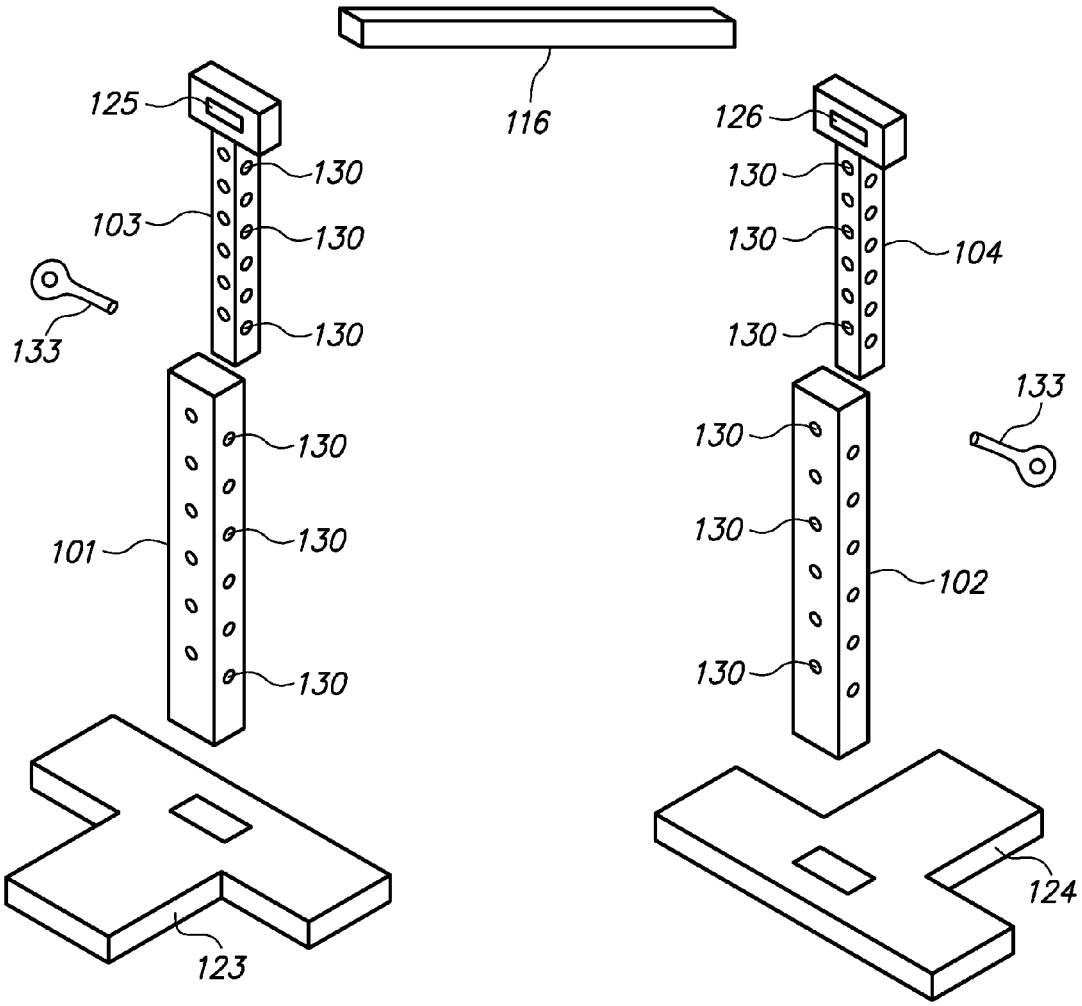
FIG. 5 shows an alternative embodiment of the apparatus which shows the vertical posts of the apparatus in an exploded view and showing how they can be reconfigured for height and length.

FIG. 5 shows the training apparatus 100 can have an additional embodiment whereby it can also be constructed to have a primary frame structure including a pair of base members 123 and 124, first and second vertical post assemblies 128 and 129 which are each comprised of one lower vertical post member 101 and 102 and one upper vertical post member 103 and 104 each lower vertical post member 101 and 102 attachable to the respective base member 123 and 124 and an upper vertical post member 103 and 104 telescopically received within the lower vertical post members 101 and 102 and selectively positionable relative thereto to adjust a height of a top end of the upper vertical post members 103 and 104 using rods 133 insertable in holes in the said posts, and a horizontal cross beam assembly including an elongate horizontal cross beam assembly 116 as shown in FIGS. 4 and 5. The top ends of the upper vertical post members are provided with receptacles 125 and 126 for receipt of outboard ends of the horizontal cross beam assembly so that the horizontal cross beam assembly spans between the spaced apart vertical post assemblies at a selected, adjusted height above the floor. The base members 123 and 124 are specifically structured to rest on a flat surface with the extending feet sections providing stability. The frame structure of the training apparatus 100 is fully collapsible and can be reconfigured for height and length.

The training apparatus 100 can be made from a variety of materials including wood, plastic and metal.

This structure is just one example of elements operable in the training apparatus.

The previously described versions of the present apparatus have many advantages, including teaching the mind of the baseball pitcher how to control his body. It corrects for the flawed mechanics inherent in the usual teaching methods used for baseball pitchers. It is an apparatus that allows the user to easily adopt the most efficient, effective and non-stress producing pitching throw based on extensive research of body mechanics and the kinetics of the throwing motion.

In addition, this invention relates to the field of exercise and training equipment and more particularly to a collapsible, portable, lightweight training device, which can be used with equal effectiveness by either left or right-handed pitchers and can be used indoors in a gymnasium or outdoors on a practice field.

It is not necessary for all embodiments of the invention to have all the advantages of the invention or fulfill all the purposes of the apparatus.

While the instant apparatus has been shown and described in accordance with preferred and practical embodiments thereof, it is recognized that departures may be made from the instant disclosure. Therefore, the spirit and scope of the appended claims should not be limited to the description of the preferred versions contained herein.

In the Summary above and in the Description, and the claims below, and in the accompanying drawings, reference is made to particular features (including method steps) of the apparatus. It is to be understood that the disclosure of the apparatus in this specification includes all possible combinations of such particular features. For example, where a particular feature is disclosed in the context of a particular aspect or embodiment of the apparatus, or a particular claim, that feature can also be used, to the extent possible, in combination with and/or in the context of other particular aspects and embodiments of the apparatus, and in the apparatus generally.

The term "comprises" and grammatical equivalents thereof are used herein to mean that other components, ingredients, steps, etc. are optionally present. For example, an article "comprising" (or "which comprises") components A, B, and C can consist of (i.e. contain only) components A, B, and C, or can contain not only components A, B, and C but also one or more other components.

Where reference is made herein to a method comprising two or more defined steps, the defined steps can be carried out in any order or simultaneously (except where the context excludes that possibility), and the method can include one or more other steps which are carried out before any of the defined steps, between two of the defined steps, or after all the defined steps (except where the context excludes that possibility).

What is claimed is:

1. A training apparatus to train a baseball pitcher comprising:

a primary frame structure operable between a collapsed condition and a plurality of assembled conditions defined by a plurality of different structural configurations, and said primary frame structure including:

a pair of vertical post assemblies;

a horizontal cross beam assembly structured for fitted, sliding receipt within said vertical post assemblies, said horizontal cross beam assembly being disposed along a common longitudinal axis to define a fully assembled length of said horizontal cross beam assembly;

a pitching mound containing a pitching plate which is planar and parallel with the surface upon which it is placed and a landing slope which is an inclined plane that is contiguous to the said pitching plate and wherein the pitching mound is of a predetermined thickness and wherein a means to secure the pitching mound to the ground is provided and wherein the pitching plate and the pitching mound both have calibrations or calibrated notches on a recessed track or rail or other mechanism along which an adjustable sliding position marker is moved traversing the entire length of the pitching plate and landing slope of the pitching mound for indicating distance traveled by the pitcher in the pitching sequence, position of the pitcher's feet placement and indicating the end point of the movement sequence;

a plurality of accessory components, and adjustment procedure for selectively adjusting an attached position of individual ones of said plurality of accessory components on said primary frame structure.

2. A baseball pitcher's training apparatus to train a pitcher as defined in claim 1 wherein each vertical post assembly is comprised of first and second base members, each of said base members having a generally T-shaped configuration defined by three feet sections, and a post socket extending upwardly from the top side of the base member at a juncture of said feet extensions;

each said vertical post assembly including a lower post member and an upper post member, said lower post member being structured and disposed to accommodate sliding, telescoping receipt of said upper post member therein;

said lower post members each including a bottom end zone structured and disposed for fitted receipt within said post socket of a respective one of said base members;

said upper post members each including a top end zone having a hollow receptacle formed therethrough;

interlocking of said upper post members to said respective lower post members at a plurality of telescopically adjusted positions in order to selectively adjust the height of said top end zone of said upper post members relative to said first and second base members;

locking of said bottom end zone of said lower post members within said post sockets of said respective base members so that said vertical post assemblies extend vertically upward from said base members; and a horizontal cross beam assembly structured for fitted, sliding receipt within said hollow receptacles of said upper post members, said horizontal cross beam assembly including first and second elongate cross beam extensions and a central coupling for releasable attachment of said cross beam extensions in end to end arrangement so that said cross beam extensions are disposed along a common longitudinal axis to define a fully assembled length of said horizontal cross beam assembly.

3. A baseball pitcher's training apparatus to train a pitcher as defined in claim 1 wherein said plurality of accessory components includes two light bag weights suspended by cords/wires from the horizontal crossbeam assembly that are longitudinally aligned in the direction of the horizontal cross beam assembly and which can be adjusted for the height they are suspended above the ground and which are structured and disposed for removable mounting to said horizontal cross beam assembly.

4. A baseball pitcher's training apparatus to train a pitcher as defined in claim 1 wherein said horizontal cross beam assembly has a distance marker calibration throughout the entire length of the said horizontal cross beam assembly.

5. A baseball pitcher's training apparatus to train a pitcher as defined in claim 1 wherein said rigid frame is comprised of metal.

6. A baseball pitcher's training apparatus to train a pitcher as defined in claim 1 wherein said rigid frame is comprised of plastic.

7. A baseball pitcher's training apparatus to train a pitcher as defined in claim 1 wherein said rigid frame is comprised of wood.

8. A method of training a baseball pitcher, comprising:

a primary frame structure operable between a collapsed condition and a plurality of assembled conditions defined by a plurality of different structural configurations, and said primary frame structure including:

a pair of vertical post assemblies;

a horizontal cross beam assembly structured for fitted, sliding receipt within said vertical post assemblies, said horizontal cross beam assembly being disposed along a common longitudinal axis to define a fully assembled length of said horizontal cross beam assembly;

a pitching mound containing a pitching plate which is planar and parallel with the surface upon which it is placed and wherein the pitching plate is of a predetermined thickness and wherein a means to secure the pitching mound to the ground is provided and said pitching mound includes a pitching plate and a landing slope and wherein the pitching plate and the pitching mound both have calibrations or calibrated notches on a recessed track or rail or other mechanism along which an adjustable sliding position marker is moved traversing the entire length of the pitching plate and landing slope of the pitching mound for indicating distance traveled by the pitcher in the pitching sequence, position of the pitcher's feet placement and indicating the end point of the movement sequence;

a plurality of accessory components, and adjustment procedure for selectively adjusting an attached position of individual ones of said plurality of accessory components on said primary frame structure; and the method comprising:

the pitcher standing on the pitching plate and contacting the light bag weight behind the pitcher's direction of throwing with the pitcher's throwing hand;

the pitcher executing a winding throwing motion to pitch a baseball;

the pitcher contacting the light bag weight above the landing slope of the pitching mound and in front of the pitcher with the pitcher's throwing hand and releasing the baseball at that point of contact;

the pitcher continuing with the baseball pitching body movement sequence onto the landing slope of the pitching mound.

* * * * *